US007174611B1

(12) United States Patent
Rose et al.

(10) Patent No.: US 7,174,611 B1
(45) Date of Patent: Feb. 13, 2007

(54) COMBINATION ARTIFICIAL CANDLE AND URN

(76) Inventors: Heinz Rose, 17580 Cerro Verde, Yorba Linda, CA (US) 92886; Norbert Rose, 17580 Cerro Verde, Yorba Linda, CA (US) 92886

( * ) Notice: Subject to any disclaimer, the term of this patent is extended or adjusted under 35 U.S.C. 154(b) by 0 days.

(21) Appl. No.: 11/541,347

(22) Filed: Oct. 2, 2006

(51) Int. Cl.
*A61G 17/00* (2006.01)

(52) U.S. Cl. ..... 27/1

(58) Field of Classification Search ..... 27/1; D99/5; D26/6–7, 10; 431/288; 362/569, 362/161
See application file for complete search history.

(56) References Cited

U.S. PATENT DOCUMENTS 5,813,098 A * 9/1998 Schneider ..... 27/1
6,520,606 B1 * 2/2003 Robinson ..... 312/111
2006/0179623 A1 * 8/2006 Robinson ..... 27/1

* cited by examiner

*Primary Examiner*—William L. Miller
(74) *Attorney, Agent, or Firm*—Morland C. Fischer

(57) ABSTRACT

A combination artificial candle and urn is disclosed to provide an aesthetically pleasing and dignified memorial to a departed loved one (e.g., a pet) who has been cremated so that the memory of the loved one will not soon be forgotten. The combination includes a hollow cylindrical (e.g., nylon) outer shell having upper and lower chambers and a partition to separate the chambers from one another. A removable top end cap is connected across the top of the outer shell, and a removable bottom end cap is connected across the bottom of the outer shell. The removable top end cap is rotated out of engagement with the outer shell to gain access to the upper chamber so that candle oil can be supplied thereteo. The removable bottom end cap is rotated out of engagement with the outer shell to gain access to the lower chamber so that the ashes of the departed loved one can be received and stored therein. A wick extends through the removable top end cap and into the upper chamber of the outer shell to communicate with the candle oil supplied thereto, whereby the wick may be lit to give the combination the appearance of a real candle.

12 Claims, 3 Drawing Sheets

COMBINATION ARTIFICIAL CANDLE AND URN

BACKGROUND OF THE INVENTION

1. Field of the Invention

This invention relates to a combination artificial candle and urn having upper and lower chambers in which to store candle oil and the ashes of a departed loved one (e.g., a pet) who has been cremated. The combination herein disclosed provides an aesthetically pleasing and dignified memorial that can be easily transported from place to place so that the memory of the loved one will not soon be forgotten.

2. Background Art

As will be known to their owners, pets can often become cherished members of the family. Once a beloved pet dies, there are few options available to the pet owner to honor the pet's memory. One option is for the owner to bury his departed pet in a pet cemetery or near his residence. Another option is for the owner to have his pet cremated. The pet's ashes are then typically buried or spread over an area which the pet is known to have frequented.

However, should the former owner move, the memory of the pet may tend to fade. That is, it may not be possible for the owner to remain near the buried remains of his pet if the owner relocates far from the burial site. In this same regard, once the pet's ashes have been buried or disbursed, the owner may not be able to easily visit the site from a remote location. In cases where the remains of a pet provide a source of comfort to its former owner, there may be a void in the owner's life which is difficult to fill.

Accordingly, what would be desirable is an aesthetically pleasing memorial and tribute to a departed pet in which the pet's ashes can be stored, easily transported, and kept nearby so that the pet will not be easily forgotten regardless of the location of the former owner.

SUMMARY OF THE INVENTION

In general terms, disclosed herein is a combination artificial candle and urn which functions as an aesthetically pleasing and dignified memorial to a departed loved one (e.g., a pet) who has been cremated so that the memory of the loved one will not be quickly forgotten. Inasmuch as the combination candle and urn can be easily transported from place to place, the cremated remains of the loved one can remain nearby even in situations where the survivors must move their residence. To this end, a photograph of the loved one may be secured around the combination as an instant reminder of the deceased.

The combination artificial candle and urn has the aesthetic appearance of a real candle. The combination includes a hollow cylindrical outer shell or body which is preferably manufactured from a durable, non-consumable material such as nylon. Located within the hollow outer shell are upper and lower chambers that are aligned one above the other and separated from one another by a laterally extending partition. A supply of candle oil is stored in the upper chamber, and the ashes of the cremated loved one is stored in the lower chamber. A wick that is supported from a metal ferrule at the top of the outer shell extends into the upper chamber to communicate with the supply of oil that is stored therewithin. Thus, the wick may be lighted to create the effect of an actual wax candle.

In order to gain access to the upper and lower chambers within the outer shell so that they can be filled with candle oil or the loved one's ashes, the combination is provided with a removable top end cap and a removable bottom end cap. A relatively wide decorative base is detachably connected to the removable bottom end cap to provide stability when the outer shell is filled and standing upright on a mantle, table or other flat surface. Each of the removable top and bottom end caps is threaded so as to be mated to the respective top and bottom ends of the outer shell. A keyhole is formed in the removable top end cap, and a slot is formed in the removable bottom end cap. One end of a key is sized to be received within the keyhole and the opposite end of the key is sized to be received in the slot. By applying a rotational force to the key, either the top or the bottom end cap is removed from or attached to the outer shell depending upon the direction of the rotational force.

DESCRIPTION OF THE PREFERRED EMBODIMENT

Figure 1:
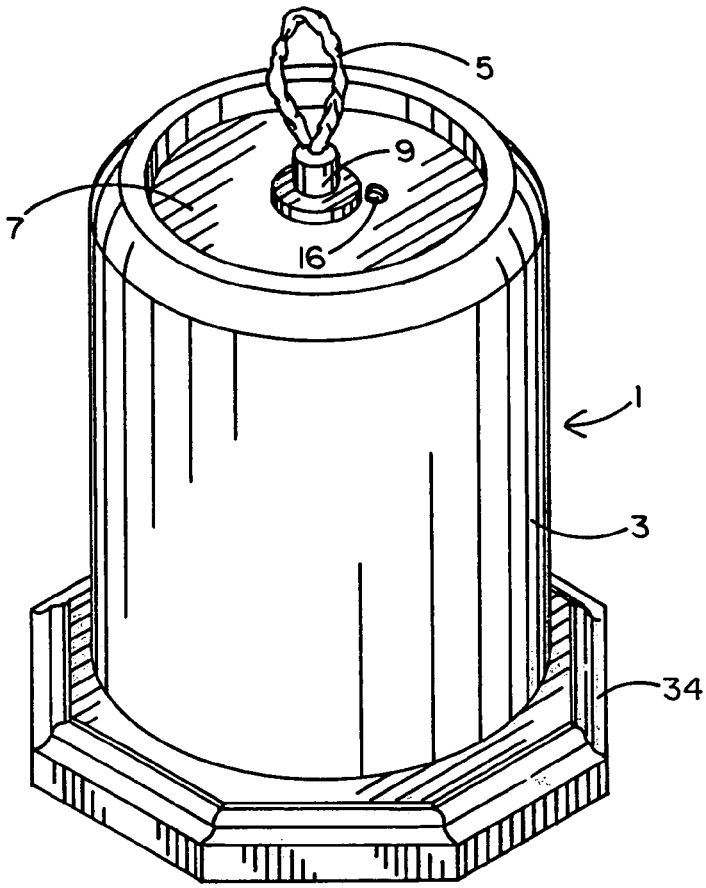
FIG. 1 shows the combination artificial candle and urn according to a preferred embodiment of the present invention.
Figure 2:
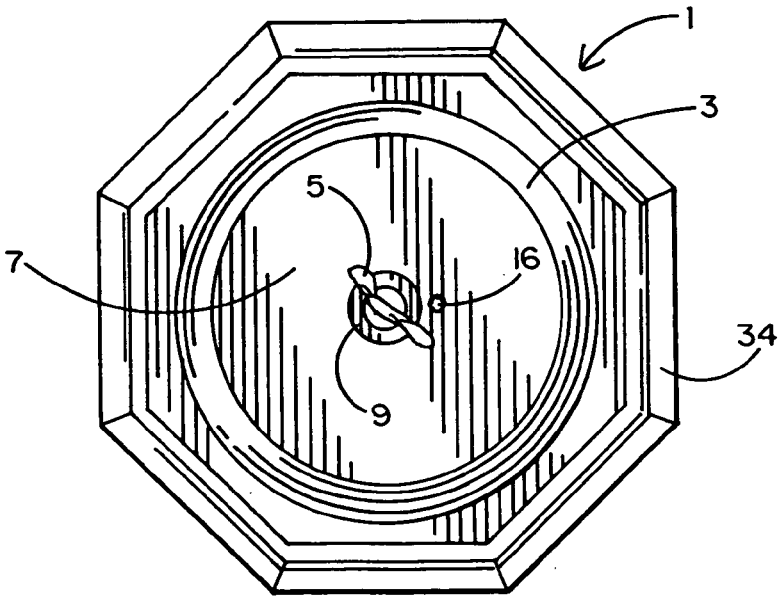
FIG. 2 is a top view of the combination artificial candle and urn shown in FIG. 1.

Referring initially to FIGS. 1 and 2 of the drawings, there is shown a combination artificial candle and urn 1 according to a preferred embodiment of our invention. The combination 1 has the decorative appearance of a typical wax candle. However, in the present case, the combination 1 has a hollow outer cylindrical shell or body 3 that is manufactured, for example, from nylon or any other suitable durable material that will not be consumed during use. Thus, and unlike a typical wax candle, the combination candle and urn 1 herein disclosed is not limited to a single use but may be regularly reused whenever and wherever such use is desired.

More particularly, and as will be disclosed in greater detail hereinafter, our combination 1 performs a dual function. The first function is that of a typical wax candle. To this end, a wick 5 is accessible at a removable (e.g., screw off) top cap 7 that is detachably connected to the top of the outer shell 3 (best shown in FIG. 3). The wick 5 extends inwardly of the outer shell 3 from the top cap 7 to communicate with a supply of fuel (e.g., lamp oil) that is stored within the outer shell 3 at a fluid-tight upper chamber (designated 10 in FIG. 3) thereof. The wick 5 is held above the removable top 7 by means of a non-flammable (e.g., metallic) ferrule 9. In the example of FIGS. 1 and 2, the wick 5 that is accessible above the outer shell 3 is turned back upon itself to form a loop for receipt through the ferrule 9 to facilitate the wick being lit after a match is struck.

The second function performed by our combination candle and urn 1 is that of a conventional urn. That is, a fluid-tight lower chamber (designated 24 in FIG. 4) is located within the outer shell 3 below the upper chamber 10. By virtue of the lower chamber 24, a user will have an aesthetically tasteful receptacle in which to store the ashes of a departed loved one who has been cremated after death so that the memory of the loved one can be preserved. In this same regard, being that the combination is easily carried, the cremated remains of the loved one may also be conveniently transported from place to place. While it is contemplated that the ashes of a pet will be stored in the lower chamber 24 within outer shell 3, it is to be understood that our combination candle and urn 1 can be used as a fitting memorial and tribute to any deceased being. To accomplish the foregoing, the size (i.e., diameter and height) of the outer shell 3 as well as the dimensions of the lower chamber 24 therewithin will vary depending upon the identity of the departed loved one and the amount of ashes to be accommodated.

Figure 3:
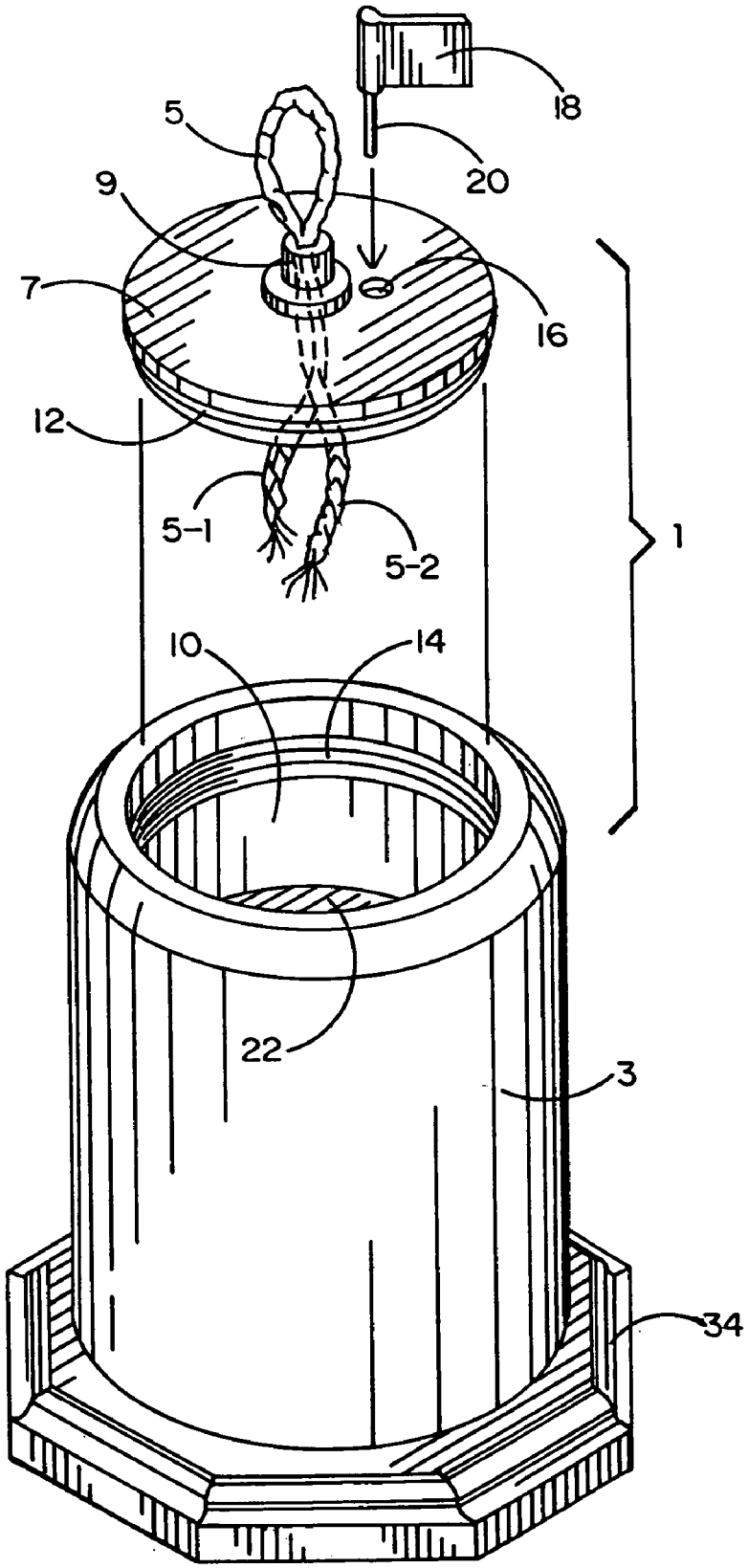
FIG. 3 is an exploded view showing a removable top end cap detached and separated from a hollow outer shell of the combination artificial candle and urn so as to gain access to an upper chamber thereof.

FIG. 3 of the drawings illustrates the removable top cap 7 detached and separated from the outer shell 3 of our combination artificial candle and urn 1 to enable the user to gain access to the upper chamber 10 within which to store a suitable supply of candle oil. The removable top cap 7 includes a set of circumferentially extending screw threads 12 around the disc-shaped periphery thereof. A complementary set of circumferentially running screw threads 14 extends around the interior at the top of the cylindrical outer shell 3. In the assembled configuration of FIG. 1, the sets of screw threads 12 and 14 are rotated into mating engagement with one another so that the removable top cap 7 is detachably connected to the top of outer shell 3, whereby the upper chamber 10 is closed and sealed until the oil supply within upper chamber 10 runs low and must be replenished. In this case, the removable top cap 7 is rotated out of engagement with the outer shell 3 (as shown) to once again permit access to the upper chamber 10.

To enable the loved one's survivor to easily rotate the removable top cap 7 into and out of engagement with the outer shell 3, a keyhole 16 is formed in top cap 7. A flag-shaped key 18 has a narrow pin 20 projecting therefrom that is sized to be received within the keyhole 16. A rotational pushing or pulling force applied to the key 18 by the survivor is imparted to the removable top cap 7 at the keyhole 16 by way of the pin 20. The removable top cap 7 is attached to or removed from the outer shell 3 depending upon the direction of the rotational force that is applied to the key 18 for transmission to cap 7 at keyhole 16.

FIG. 3 shows a partition 22 located at the interior of the hollow outer shell 3. The partition 22 runs laterally through the outer shell 3 in order to separate the fluid-tight upper chamber 10 from the fluid-tight lower chamber 24 (best shown in FIG. 4). Therefore, separate chambers are established in which to store and carry respective volumes of candle oil and the ashes of a loved one. FIG. 3 also shows the wick 5 being suspended by the non-flammable ferrule 9 at the removable top cap 7. As earlier indicated, the top of the wick 5 has a loop configuration to better maintain a flame. A pair of loop ends 5-1 and 5-2 drop downwardly from the ferrule 9 for receipt within the oil supply that is stored in the upper chamber 10 of outer shell 3 so that candle oil will be transported along the wick 5 by means of capillary action.

Figure 4:
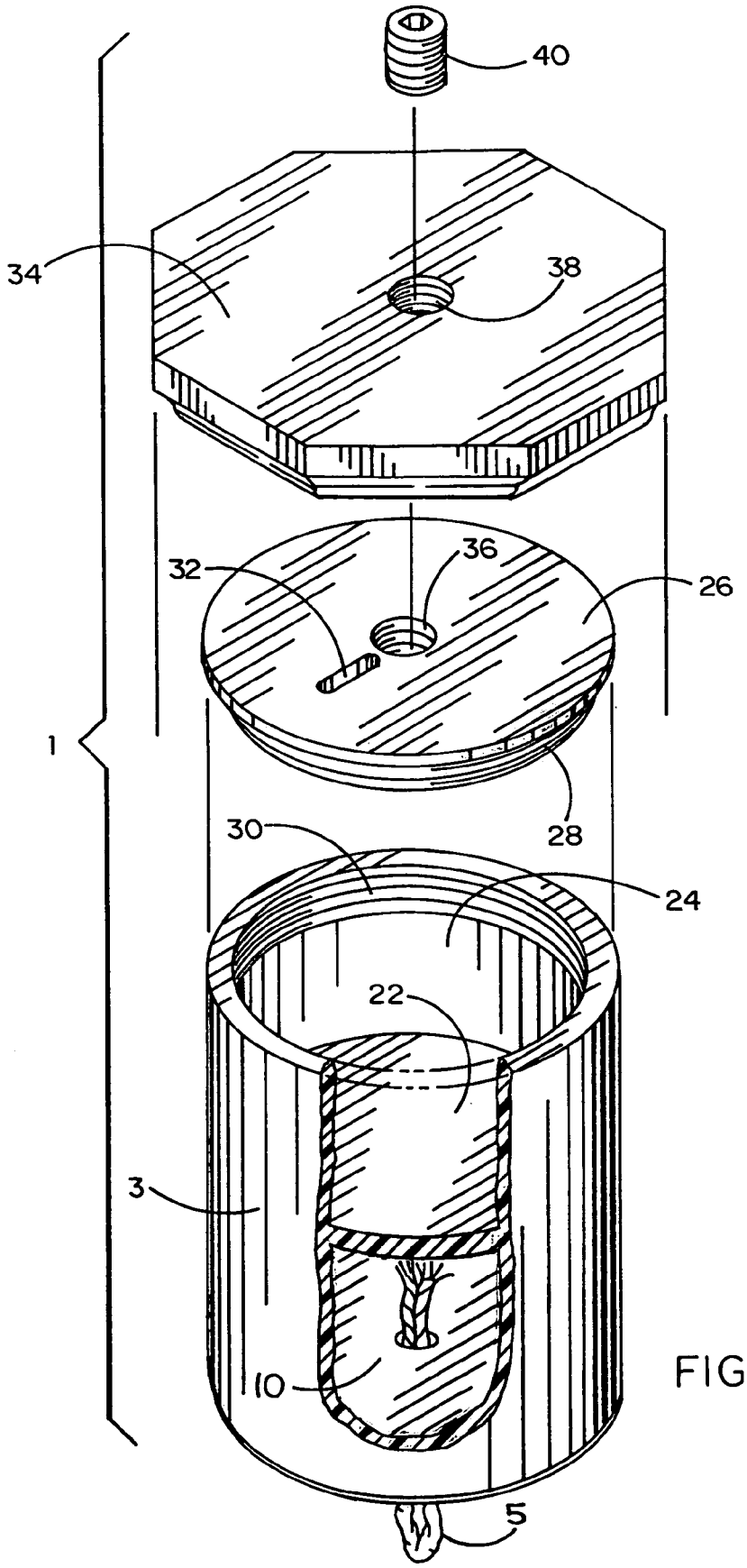
FIG. 4 is an exploded view showing a bottom end cap and a base detached and separated from the bottom of the outer shell of the combination so as to gain access to a lower chamber thereof.

Turning now to FIG. 4 of the drawings, an exploded view of our combination artificial candle and urn 1 is shown after the outer shell 3 thereof is turned upside down relative to that shown in FIG. 3. In this case, the lower chamber 24 is illustrated at the interior of the hollow outer shell 3. As earlier indicated, the lower chamber 24 is separated from the upper chamber 10 by a partition 22 so as to isolate the ashes stored in the lower chamber 24 from the candle oil that is stored in the upper chamber 10.

FIG. 4 also illustrates a removable bottom cap 26 that is detached and separated from the bottom of the outer shell 3 to permit access to the lower chamber 24 to be supplied with the ashes of the survivor's loved one. Like the removable top cap 7 of FIG. 3, the removable bottom cap 26 includes a set of screw threads 28 extending around the disc-shaped periphery thereof. A complementary set of circumferentially running screw threads 30 extends around the interior of the cylindrical outer shell 3 at the bottom thereof. In the assembled configuration of FIG. 3, the sets of screw threads 28 and 30 are rotated into mating engagement with one another so that the removable bottom cap 26 is detachably connected to the bottom of the outer shell 3, whereby the lower chamber 24 is closed and sealed until a decision is made to remove the ashes therefrom. In this case, the removable bottom cap 26 is rotated out of engagement with the outer shell 3 (as shown) to once again permit access to the lower chamber 24. When fully assembled, the removable top and bottom caps 7 and 26 lie facing one another at opposite ends of the outer shell 3 with the partition 22 disposed in spaced parallel alignment therebetween.

To enable the survivor to easily rotate the removable bottom cap 26 into and out of engagement with the outer shell 3, a slot 32 is formed in the bottom cap 26. The slot 32 is sized for receipt of the opposite (e.g., flag-shaped) end of the key 18 that was earlier described when referring to FIG. 3. A rotatable pushing or pulling force applied to the key 18 is imparted to the removable bottom cap 26 at the slot 32 by way of the flag-shaped end of key 18. The removable bottom cap 26 is attached to or removed from outer shell 3 depending upon the direction of the rotational force applied by the survivor to the key 18 for transmission to cap 26 at slot 32.

In this same regard, it may be appreciated that the pin 20 at one end of key 18 is inserted within the keyhole 16 of FIG. 3 to impart a rotation to the removable top cap 7. Moreover, the opposite (flag-shaped) end of key 18 is inserted within the slot 32 of FIG. 4 to impart a rotation to the removable bottom cap 26. In other words, opposite ends of the key 18 are used to impart a rotational force when it is desirable to separate either one of the removable top cap 7 or the removable bottom cap 28 from the outer shell 3 of our combination candle and urn 1. By having to use different ends of the key 18, the survivor will be less likely to make a mistake and inadvertently open the wrong end of the outer shell 3.

To enhance the stability of our combination candle and urn 1, a relatively wide, flat base or platform 34 is attached to the bottom of the outer shell 3 over the removable bottom cap 26. The base 34 is preferably manufactured from aesthetically pleasing wood or any other suitable material. To accomplish the foregoing, a pair of axially aligned threaded holes 36 and 38 are formed through the removable bottom cap 26 and base 34, respectively. The removable bottom cap 26 is detachably connected to the outer shell 3 (as shown in FIG. 1), and the flat base 34 is laid over bottom cap 26. A threaded fastener 40 is rotated through the threaded hole 38 in the base 34 and into mating engagement with the threaded hole 36 in the removable bottom cap 26. Thus, when the combination 1 is assembled and turned right side up, the base 34 will rest on a flat surface (e.g., a fireplace mantle, a table, a shelf, or the like) and the outer shell 3 will be supported upon and stand upwardly therefrom. Of course, the fastener 40 must first be removed and the base 34 separated from the removable bottom cap 26 before the key (designated 18 in FIG. 2) can be used to detach the bottom cap 26 from outer shell 3.

Should the survivor wish, a picture (not shown) may be attached (e.g., adhesively bonded) to the cylindrical outer shell 3 of our combination artificial candle and urn 1 so as to reinforce the memory of the departed loved one. The wick 5 may be lit on a regular basis or from time to time to commemorate special occasions (e.g., dates of birth and/or death). In either event, the combination 1 herein disclosed provides an attractive but dignified memorial in which to store the ashes of a departed loved one while, at the same time, enabling a flame to be lit to commemorate the loved one's life.

The invention claimed is:

1. A combination candle and urn memorial to a departed loved one who has been cremated, said memorial comprising a hollow outer shell, a first chamber within said outer shell which receives a liquid fuel, a second chamber within said outer shell which receives the ashes of the cremated loved one, a partition within said outer shell to separate said first and second chambers from one another, and a wick extending into said first chamber so as to communicate with the liquid fuel received therein.

2. The memorial recited in claim 1, further comprising a removable top end cap connected across a top of said outer shell, said removable top end cap being detached and separated from said outer shell to permit access to said first chamber so that said first chamber can receive the liquid fuel therein.

3. The memorial recited in claim 2, wherein said wick extends through the removable top end cap at the top of said outer shell to said first chamber so as to communicate with the liquid fuel received by said first chamber.

4. The memorial recited in claim 3, further comprising a fire-resistant ferrule at said removable top end cap to hold one end of said wick above said removable top end cap and suspend the opposite end of said wick within the first chamber of said outer shell.

5. The memorial recited in claim 2, further comprising a removable bottom end cap connected across the bottom of said outer shell, said removable bottom end cap being detached and separated from said outer shell to permit access to said second chamber so that said second chamber can receive the ashes of the cremated loved one.

6. The memorial recited in claim 5, further comprising a base connected to said removable bottom end cap to lie upon a flat surface, said outer shell standing upwardly from and supported by said base when said removable bottom end cap is connected across the bottom of said outer shell.

7. The memorial recited in claim 5, wherein said removable top end cap has a set of screw threads extending therearound and the top of said outer shell has a complementary set of screw threads, a rotational force applied to said removable top end cap causing said removable top end cap to rotate into or out of mating engagement with the top of said outer shell depending upon the direction of said rotational force.

8. The memorial recited in claim 7, wherein said removable bottom end cap has a set of screw threads extending therearound and the bottom of said outer shell has a set of complementary set of screw threads, a rotational force applied to said removable bottom end cap causing said removable bottom end cap to rotate into or out of mating engagement with the bottom of said outer shell depending upon the direction of said rotational force.

9. The memorial recited in claim 8, wherein said removable top end cap has a first opening formed therein at which is applied the rotational force for causing said removable top end cap to rotate into or out of mating engagement with the top of said outer shell.

10. The memorial recited in claim 9, wherein said removable bottom end cap has a second opening formed therein at which is applied the rotational force for causing said removable bottom end cap to rotate into or out of mating engagement with the bottom of said outer shell.

11. The memorial recited in claim 10, further comprising a key sized to be received within the first and second openings formed in said removable top and said removable bottom end caps, a rotational force applied to said key being imparted to said removable top and bottom end caps at the respective first and second openings formed therein, whereby to cause said removable top end cap to rotate into or out of mating engagement with the top of said outer shell and said removable bottom end cap to rotate into or out of mating engagement with the bottom of said outer shell.

12. The memorial recited in claim 1, wherein said outer shell has a cylindrical configuration, said wick projecting outwardly from said outer shell to give said memorial the appearance of a candle, said second chamber within said outer shell creating an urn in which the ashes of the cremated loved one are received and stored.

* * * * *